US006427671B1

(12) United States Patent
Holze et al.

(10) Patent No.: US 6,427,671 B1
(45) Date of Patent: Aug. 6, 2002

(54) EXHAUST GAS RECIRCULATION MIXER APPARATUS AND METHOD

(75) Inventors: Gordon H. Holze, Dunlap; Keith E. Lawrence, Peoria; Samuel L. Montooth, Dahinda, all of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/617,759

(22) Filed: Jul. 17, 2000

(51) Int. Cl.[7] ..... F02M 25/07

(52) U.S. Cl. ..... 123/568.17; 137/561 A; 366/336

(58) Field of Search ..... 123/568.17; 137/590, 137/590.5, 592, 561 A; 366/336–338

(56) References Cited

U.S. PATENT DOCUMENTS 4,294,220 A 10/1981 Yasuhara et al.
4,521,117 A 6/1985 Ouwerkerk et al.
4,681,129 A * 7/1987 Juzi et al. ..... 137/561 A
5,196,148 A 3/1993 Nigrelli
5,207,714 A * 5/1993 Hayashi et al. ..... 123/568.17
5,492,104 A * 2/1996 Elder et al. ..... 123/568.17
6,209,530 B1 * 4/2001 Faletti et al. ..... 123/568.21

* cited by examiner

*Primary Examiner*—Willis R. Wolfe
*Assistant Examiner*—Arnold Castro
(74) *Attorney, Agent, or Firm*—James B. Golden; Larry G. Cain

(57) ABSTRACT

This invention relates generally fluid mixer assembly and more particularly to an exhaust gas recirculation (EGR) mixer comprising an inlet conduit, an exhaust conduit, and a shielded conduit. The shielded conduit is partially disposed in the inlet conduit and has a fluid diverting portion and fluid passing portion. The fluid diverting portion diverts intake air into a first fluid stream and a second fluid stream. Exhaust gas is passed through fluid passing portion and is mixed with the first fluid stream and second fluid stream generally at a point downstream of the shielded conduit.

20 Claims, 2 Drawing Sheets

Fig. 2
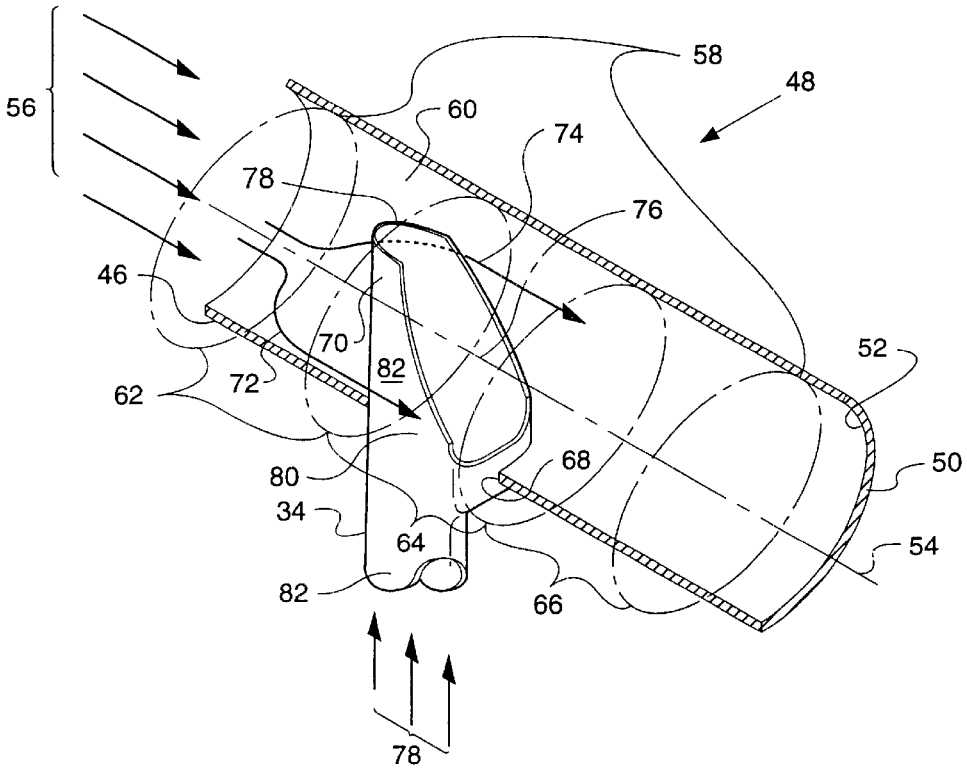
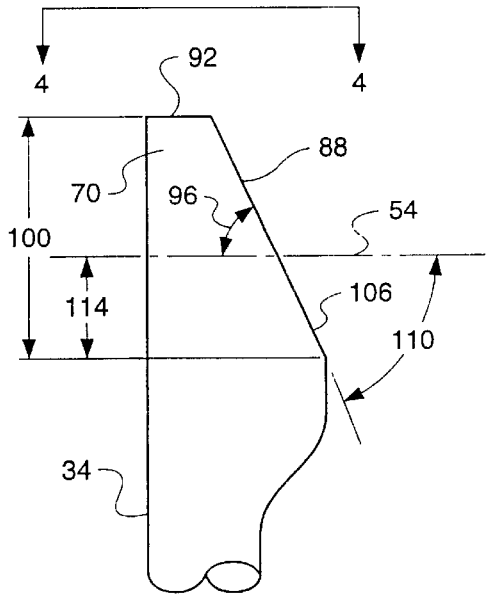
Fig. 3
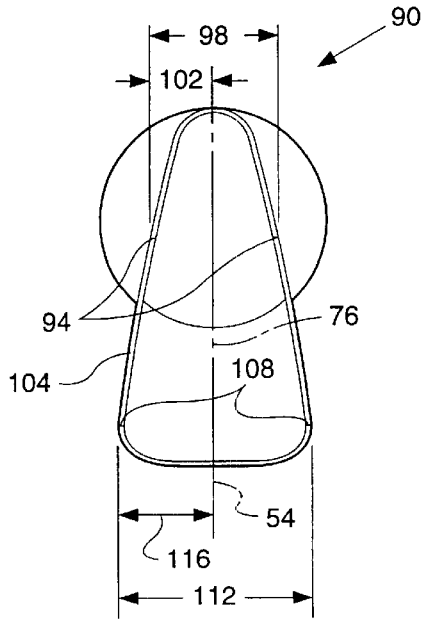
Fig. 4

EXHAUST GAS RECIRCULATION MIXER APPARATUS AND METHOD

TECHNICAL FIELD

This invention relates generally to a fluid mixer assembly and more particularly to a shielded conduit for mixing exhaust gas from an exhaust gas recirculation (EGR) system with the intake air supply of an internal combustion engine.

BACKGROUND ART

An Exhaust Gas Recirculation (EGR) system reduces unwanted emissions resulting from the combustion process in an internal combustion engine. When combustion occurs in an environment with an excess of oxygen, peak temperatures in a combustion chamber increases leading to the formation of NOx. The EGR system introduces exhaust gas having a low oxygen concentration into an inlet manifold of the internal combustion engine to lower the concentration of oxygen. By reducing the oxygen concentration, fuel burns slower and reduces peak temperatures in the combustion chamber. Also, the recirculated exhaust gas absorbs some of the heat released during combustion.

One problem inherent with the introduction of exhaust gas into the inlet manifold, is that during operation, engines typically exhibit different firing characteristics for each combustion chamber. It has been found that the overall charge introduced to the cylinder's inlet valves lacks uniformity and can vary widely in quality when exhaust gas is mixed with the intake air.

Because of the desire to control the combustion event in any cylinder, and thereby to a degree to control the quality of the overall charge introduced, it has made it desirable to more closely regulate the composition of the overall charge. That is, the intake air and the exhaust gas are combined to form an aggregate charge. To have the engine operate efficiently and satisfactory from the point of view of emissions control, it is desirable to maintain a degree of uniformity and consistency in the initial aggregate charge and thus control the mixing between constituents.

The present invention is directed to overcoming one or more of the problems set forth above.

DISCLOSURE OF THE INVENTION

In one aspect of the present invention a fluid mixer assembly comprises an inlet conduit and a shielded conduit. The inlet conduit has a connector bore that is formed by a cylindrical surface and has a longitudinal axis. The connector bore forms a first cavity which has a preestablished volume. The inlet conduit has a first fluid passing therethrough. The shielded conduit is partially positioned within the first cavity and has a first surface extending between a pair of ends and defines a first predetermined width. A second surface extends between a pair of ends and defines a second predetermined width. A pair of third surface connects a corresponding end of the first and second surfaces. The pair of third surfaces are at an acute angle with said longitudinal axis. The second predetermined width is greater in length than the first predetermined width. A perimeter at the first surface, the second surface, and the pair of third surfaces define a second cavity. The shielded conduit has a second fluid passing therethrough and is in communication with the first fluid.

In another aspect of the present invention a method of mixing exhaust gas with intake air has an exhaust manifold, a shielded conduit, and an intake conduit. The method comprises the steps of passing inlet air through the inlet conduit. Passing exhaust gas from the exhaust manifold through the shielded conduit, and into the inlet conduit. Diverting the intake air about the shielded conduit into a first fluid stream and a second fluid stream. Re-combining the first fluid stream and the second fluid stream at a point downstream of the shielded conduit with the exhaust gas.

BRIEF DESCRIPTION OF THE DRAWINGS

FIG. 2 is a diagrammatic partial cross-sectional view of the shielded conduit of FIG. 1 embodying the present invention;

FIG. 3 is a diagrammatic side view of the shielded conduit embodying the present invention; and FIG. 4 is a top view of the shielded conduit of FIG. 3 embodying the present invention.

BEST MODE FOR CARRYING OUT THE INVENTION

Figure 1:
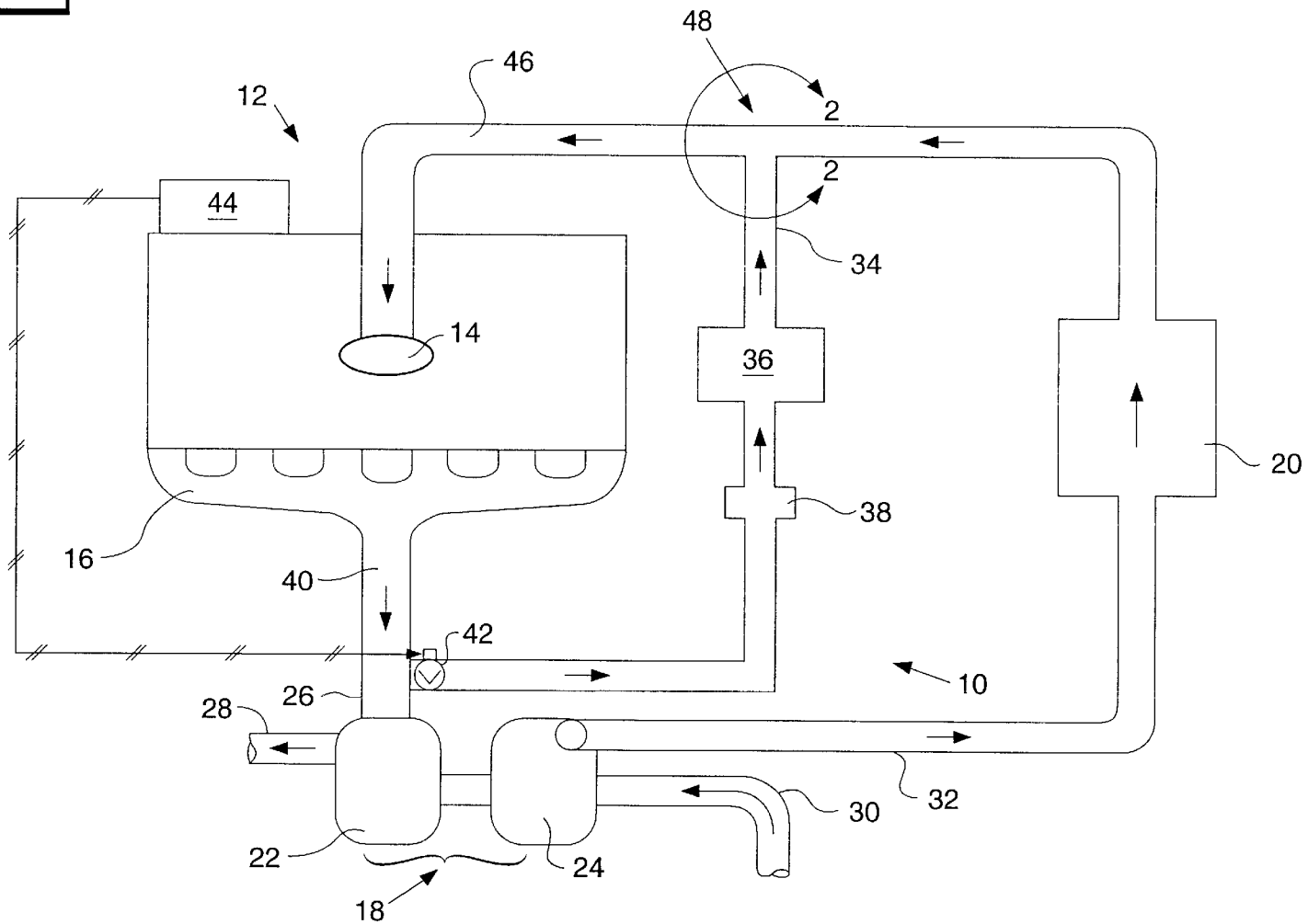
FIG. 1 is a schematic representation of an exhaust gas recirculation (EGR) system for a turbocharged engine embodying the present invention.

Turning now to the drawings and particularly to FIG. 1 there is shown a schematic representation of an exhaust gas recirculation (EGR) system 10 for a turbocharged compression ignition engine 12 (i.e. diesel engine). As seen therein, the turbocharged compression ignition engine 12 includes an intake manifold 14, exhaust manifold 16, a turbocharger 18, and an air-to-air aftercooler 20. The turbocharger 18 is typically a fixed geometry turbocharger 18 having an exhaust gas driven turbine 22 coupled to an intake air compressor 24. The turbocharger 18 also includes an exhaust gas inlet 26 and an exhaust gas outlet 28 both in fluid communication with the exhaust gas driven turbine 22. The turbocharger 18 further includes a fresh intake air conduit 30 and a compressed air exit conduit 32 both of which are in fluid communication with the air compressor 24.

In the preferred embodiment, the EGR system 10 includes a shielded conduit 34, an EGR cooler 36 or heat exchanger 36, and an optional particulate trap 38. As seen in FIG. 1, the shielded conduit 34 is disposed in fluid communication with an exhaust conduit 40 and is adapted for diverting a flow of exhaust gas from exhaust conduit 40 to a position downstream of the turbocharger 18 and air-to-air aftercooler 20 and proximate the intake manifold 14. The diverted flow of exhaust gas from the exhaust conduit 40 via the shielded conduit 34 is controlled using one or more EGR diversion valves 42 operatively associated with an engine controller 44 or similar such engine control module 44.

As best seen in FIG. 2, the diverted flow of exhaust gas is communicated to an inlet conduit 46 by way of a fluid mixer assembly 48. The fluid mixer assembly 48 includes the shielded conduit 34 partially positioned within the inlet conduit 46.

The inlet conduit 46 includes a connector bore 50. In the preferred embodiment, the connector bore 50 is formed by a cylindrical surface 52 and a longitudinal axis 54. Other types of connector bores 50 may be used, such as, elliptical, rectangular, and the like to provide a first fluid 56 to the internal combustion engine 12. The inlet conduit 46 is used to pass a first fluid 56, such as, compressed and aftercooled inlet air. The connector bore 50 forms a first cavity 58 having a preestablished volume 60. The first cavity 58 is located within the inlet conduit 46 and positioned, such that, the shielded conduit 34 is partially positioned within the first cavity 58. For clarity, the first cavity 58 is divided into a diverting portion 62, a transitional portion 64, and a mixing portion 66. Furthermore, the inlet conduit 46 has an opening 68 in the connector bore 50 for receiving the shielded conduit 34.

The diverting portion 62 of the first cavity 58 is generally located upstream of the shielded conduit 34 and extends from a fluid diverting portion 70 of the shielded conduit 34. In flow direction of the first fluid 56, the diverting portion 62 of the first cavity 58 that is located upstream of the shielded conduit 34 coincides with having unimpeded flow of the first fluid 56 for the internal combustion 12. As the first fluid 56 lows through the diverting portion 62 it is impeded by the shielded conduit 34. The diverting portion 62 of the first cavity 58 provides an obstacle that partitions the first fluid 56 into a first fluid stream 72 and a second fluid stream 74.

The transitional portion 64 of the first cavity 58 is adjacent to the diverting portion 62 and is generally associated with a region within the inlet conduit 46 which corresponds to the location of the shielded conduit 34 disposed in the inlet conduit 46. The transitional portion 64 of the first cavity 58 corresponds to the region within the first cavity 58 where a second cavity 76 of the shielded conduit 34 passes a second fluid 78, such as, exhaust gas into the inlet conduit 46. The transitional portion 64 of the first cavity 58 coincides with having the first fluid stream 72 and second fluid stream 74 pass the shielded conduit 34 in at least two separate fluid streams 72, 74.

The mixing portion 66 of the first cavity 58 is generally located downstream of the shielded conduit 34 and extends from a fluid passing portion 80 of the shielded conduit 34. The mixing portion 66 of the first cavity 58 located downstream corresponds to the region within the inlet conduit 46 where the diverted flow of the first fluid 56, i.e. the first fluid stream 72 and the second fluid stream 74 are combined with the second fluid 78. The mixing of the first fluid, i.e. intake air and the exhaust gas 78 are substantially mixed downstream of the shielded conduit 34.

The shielded conduit 34, as shown in FIG. 2, is partially positioned within the inlet conduit 46. It should be recognized that applications having multiple shielded conduits 34 disposed in the inlet conduit 46 may be used without departing from the spirit of the invention. The shielded conduit 34 includes an inlet portion 82, a fluid diverting portion 70, and a fluid passing portion 80. The fluid diverting portion 70 and fluid passing portion 80 are in sealing engagement with the opening 68 of the inlet conduit 46. The shielded conduit 34 transitions between the fluid diverting portion 70 and the fluid passing portion 80. This transition is typically achieved by having a third surface 88, i.e. transitional surface 88 located between the fluid diverting portion 70 and the fluid passing portion 80. In the preferred embodiment a pair of third surface 88 are provided and incline upwardly from said fluid passing portion 80 to said fluid diverting portion 70. However, other types of transitional surfaces 88 may be used without departing from the spirit of the invention. For example, non-inclining, slanted, notched, rounded, and the like may be suitable for transitioning between the fluid diverting portion 70 and the fluid passing portion 80.

The inlet portion 82 of the shielded conduit 34 is connected to the exhaust conduit 40. The type of connection between the shielded conduit 34 and the exhaust conduit 40 is well known to somebody skilled in the art. For example, the connection could be achieved by using a clamp, bellow, weld, and the like without departing from the spirit of the invention.

The fluid diverting portion 70 is partially positioned within the diverting portion 62 of the first cavity 58. The fluid diverting portion 70 provides an obstacle for the first fluid 56, i.e. intake air and thus diverts the flow of first fluid 56 into the first fluid stream 72 and the second fluid stream 74. As shown in FIG. 2 and in particular FIG. 3, the fluid diverting portion 70 of the shielded conduit 34 is preferably of a rounded profile 90, such as, a rounded corner. Other profiles may be used and still provide the level of diversion of the first fluid 56 into the first fluid stream 72 and second fluid stream 74. For example, a less rounded wedge shape or a flap. The fluid diverting portion 70 includes a first surface 92 that is formed between a pair of ends 94. The first surface 92 is generally at an acute angle with the longitudinal axis 54 of the inlet conduit 46. However, the first surface 92 could also be in a parallel relationship to the longitudinal axis 54 without departing from the gist of the invention. Furthermore, The first surface 92 may be of an arcuate design ranging between the pair of ends 94. The pair of third surfaces 88 are generally tangential to the first surface 92. A first predetermined width 98 is measured from the pair of ends 94 of the first surface 92. The first surface 92 is located in the inlet conduit 46 at a first predetermined height 100 measured from the longitudinal axis 54. The first surface 92 is further characterized by way of a third predetermined width 102 measured from the longitudinal axis 54.

The fluid passing portion 80 is partially positioned within the transitional portion 64 of the first cavity 58. The fluid passing portion 80 includes the second cavity 76 for passing the second fluid 78, i.e. exhaust gas, from the shielded conduit 34 into the inlet conduit 46. The second cavity 76 is defined by a perimeter 104 bounded by the first surface 92, a second surface 106, and the pair of third surfaces 88. The perimeter 104, in one example, defines a triangular configuration having rounded corners. As depicted in FIG. 2, the fluid passing portion 80 of the shielded conduit 34 and the corresponding transitional portion 64 of the first cavity 58 have at least three generally separate flow paths 72, 74, 78 passing through the inlet conduit 46. In particular, the first fluid stream 72 and second fluid stream 74 are passing past the shielded conduit 34 in such a manner that there is a generally a region within the first cavity 58 where the first fluid stream 72 and second fluid stream 74 are absent. In the preferred embodiment the absent region 78 is located above the second cavity 76 of the shielded conduit 34. It should be recognized that the region specified above may be of different shapes or sizes depending on the physical characteristics of the shielded conduit 34 without departing from the spirit of the invention. The fluid passing portion 80 includes the second surface 106 that is formed between a pair of ends 108. The second surface 106 is generally at a second acute angle 110 with the longitudinal axis 54 of the inlet conduit 46. However, the second surface 106 could also be in a parallel relationship to the longitudinal axis 54 without departing from the gist of the invention. In addition, the second surface 106 may be of an arcuate design ranging between the pair of ends 108. The pair of third surfaces 88 are generally tangential to the second surface 106 as mentioned previously for the first surface 92. A second predetermined width 112 is measures from the pair of ends 108 of the second surface 106. In the preferred embodiment, the second predetermined width 112 is generally greater in length than the first predetermined width 100 providing the flow characteristics as described above. The pair of third surfaces 88 may be non-parallel and extends radially outward from the first surface 92 towards the second surface 106. Furthermore, the second surface 106 is located in the inlet conduit 46 at a second predetermined height 114 measured from the longitudinal axis 54. In the preferred embodiment the first predetermined height 100 for the first surface 92 and the second predetermined height 114 for the second surface 106 are generally equal in length. The second surface 106 is further characterized by way of a forth predetermined width 116 measured from the longitudinal axis 54. In the preferred embodiment the third predetermined width 102 of the first surface 92 and the forth predetermined width 116 of the second surface 106 are generally not equal in length.

Industrial Applicability

In operation exhaust gas is recirculated into the intake manifold 14 for improved emissions. Exhaust gas exits the engine 12 through the exhaust manifold 16 and is communicated to the exhaust gas inlet 26 (if applicable) and to the shielded conduit 34 for recirculating exhaust gas with the first fluid 56. The amount of exhaust gas passed through the shielded conduit 34 is determined by the EGR diversion valve 42 and the engine controller 44. In most applications the EGR cooler 36 is provide to cool the recirculated exhaust gas that is being passed into the intake manifold 14. In addition to the EGR cooler 36, particulate traps 38 may be used to further reduce the level of particulate emissions that are recirculated to the intake manifold 14. In addition to exhaust gas recirculation 10, exhaust gas may be used to drive the exhaust gas driven turbine 22 which in turn operates the intake air compressor 24. The first fluid 56, i.e. intake air is compressed by the intake air compressor 24 and cooled by the air-to-air aftercooler 20. The intake air is then mixed with the exhaust gas that is recirculated through the shielded conduit 34 with the fluid mixer assembly 48.

The fluid mixer assembly 48 provides immediate mixing of the recirculated exhaust gas 10 with the first fluid 56, i.e. intake air. Intake air passing through the first cavity 58 of the inlet conduit 46 is diverted by the fluid diverting portion 70 of the shielded conduit 34 into at least two separate streams, i.e. the first fluid stream 72 and the second fluid stream 74. The intake air 56 continues to flow in separate streams 72, 74 through the transitional portion 64 of the first cavity 58. The transitional portion 64 of the first cavity 58 corresponds to the passing of the second fluid 74, i.e. exhaust gas through the second cavity 76 and into the first cavity 58 of the inlet conduit 46. The separate fluid streams 72, 74 allows a larger pressure differential to be realized between the second fluid 78 and the first fluid 56 at the second cavity 76 improving the flow characteristics of the exhaust gas into the first cavity 58 of the inlet conduit 46. The mixing portion 66 of the first cavity 58 provides the mixing of the first fluid stream 72, the second fluid stream 74, and the exhaust gas 78.

A method of mixing exhaust gas, i.e. exhaust gas 78 with intake air 56. The EGR system 10 includes the exhaust manifold 16, the shielded conduit 34, and the inlet conduit 46. Pass the intake air 56 through the inlet conduit 46 and the exhaust gas 78 from the exhaust manifold 16 through the shielded conduit 34 and into the inlet conduit 46. Divert the intake air 56 about the shielded conduit 34 into a first fluid stream 72 and a second fluid stream 74. The first fluid stream 72 is diverted by having the first fluid 56 contact the fluid diverting portion 70 of the shielded conduit 34. The contact of the first fluid 56 with the fluid diverting portion 70 branches the intake air 56 into the first fluid stream 72 and second fluid stream 74. The first fluid stream 72 and second fluid stream 74 is disengaged from the fluid passing portion 80 of the shielded conduit 34. Re-combine the first fluid stream 72 and the second fluid stream 74 at a point downstream of the shielded conduit 34 with the exhaust gas 78.

EGR systems 10 that utilize the fluid mixer assembly 48 have improved engine 12 operation. The first fluid 56 and second fluid 78 mixture as discussed above provides a more uniform mixture for the charge introduced into the engine 12 for combustion. The degree of control in the quality of the overall charge allows the engine 12 to operate efficiently and satisfactory from the point of view of emission controls. The fluid mixture of the present invention provide consistency for the mixture to individual cylinders for combustion.

Other aspects, objects and advantages of this invention can be obtained from a study of the drawings, the disclosure and the appended claims.

What is claimed is:

1. A fluid mixer assembly, comprising:

an inlet conduit having a diverting portion, a transition portion and a mixing portion, a connector bore being formed by a cylindrical surface and having a longitudinal axis, said connector bore forming a first cavity having a preestablished volume, and said inlet conduit having a first fluid passing therethrough from said diverting portion toward said mixing portion;

a shielded conduit being partially positioned within said first cavity having a first surface extending between a pair of ends and defining a first predetermined width, a second surface extending between a pair of ends and defining a second predetermined width, and a third surface connecting a corresponding end of said first and second surfaces, said third surface being at an acute angle with said longitudinal axis, said second predetermined width being greater in length than said first predetermined width, a perimeter at said first surface, said second surface, and said third surface defining a second cavity, said second cavity having a generally triangular configuration forming an apex portion, said apex portion being directed toward said diverting portion, and said shielded conduit having a second fluid passing therethrough and being in communication with said first fluid.

2. The fluid mixer assembly, as set forth in claim 1, wherein said third surface being non-parallel and extending radially outward from said first surface towards said second surface.

3. The fluid mixer assembly, as set forth in claim 1, wherein said first surface and second surface being arcuate.

4. The fluid mixer assembly, as set forth in claim 3, wherein said third surface each being tangential to said first and second surfaces.

5. The fluid mixer assembly, as set forth in claim 1, wherein said first surface and second surface each being generally at said acute angle.

6. The fluid mixer assembly, as set forth in claim 1, wherein said first surface being generally parallel with said longitudinal axis.

7. The fluid mixer assembly, as set forth in claim 1, wherein said first surface having a first predetermined height measured from said longitudinal axis, said second surface having a second predetermined height measured from said longitudinal axis, and said first predetermined height and said second predetermined height being generally equal in length.

8. The fluid mixer assembly, as set forth in claim 1, wherein said first surface having a third predetermined width measured from said longitudinal axis, said second surface having a forth predetermined width measured from said longitudinal axis, and said third predetermined width and said forth predetermined width being generally equal in length.

9. The fluid mixer assembly, as set forth in claim 1, wherein said shielded conduit being centrally positioned within said first cavity.

10. The fluid mixer assembly, as set forth in claim 1, wherein said triangular configuration having rounded corners.

11. An exhaust gas recirculation system for use with an internal combustion engine, comprising:

an inlet conduit having a connector bore being formed by a cylindrical surface and having a longitudinal axis, said connector bore forming a first cavity having a preestablished volume, said first cavity defining a diverting portion, a transitional portion, and a mixing portion, and said inlet conduit having a first fluid passing therethrough;

an exhaust conduit being connected to the internal combustion engine; and a shielded conduit being partially positioned within said first cavity, said shielded conduit having an inlet portion being connected to said exhaust conduit, a fluid diverting portion being partially positioned within said diverting portion, and a fluid passing portion being partially positioned within said transitional portion, said fluid passing portion having a generally triangular configuration forming an apex portion, said apex portion being directed toward said diverting portion.

12. The exhaust gas recirculation system for use with an internal combustion engine as set forth in claim 11, wherein said internal combustion engine includes a turbocharger.

13. The exhaust gas recirculation system, as set forth in claim 11, wherein said fluid diverting portion and said fluid passing portion defines a transitional surface being inclined upwardly from said fluid passing portion to said fluid diverting portion.

14. The exhaust gas recirculation system, as set forth in claim 13, wherein said fluid diverting portion defines a first predetermined width, said fluid passing portion defines a second predetermined width, and said second predetermined width being greater in length than said first predetermined width.

15. The exhaust gas recirculation system, as set forth in claim 11, wherein said inlet conduit passing atmospheric air, said exhaust conduit passing exhaust gas, and said atmospheric air and exhaust gas being substantially mixed downstream of said shielded conduit.

16. The exhaust gas recirculation system, as set forth in claim 11, wherein said inlet conduit having an opening and said fluid passing portion and diverting portion being in sealing engagement with said opening of the inlet conduit.

17. The exhaust gas recirculation system, as set forth in claim 11, wherein said fluid diverting portion having a first predetermined height measured from said longitudinal axis, said fluid passing portion having a second predetermined height measured from said longitudinal axis, and said first predetermined height and said second predetermined height being generally equal in length.

18. The fluid mixer assembly, as set forth in claim 11, wherein said shielded conduit being centrally positioned within said first cavity.

19. A method of mixing exhaust gas with intake air having an exhaust manifold, a shielded conduit, having a generally triangular configuration and an intake conduit, the method comprising the steps of:

passing inlet air through said inlet conduit;

passing exhaust gas from said exhaust manifold through said shielded conduit, having a generally triangular configuration and into said inlet conduit;

diverting said intake air about said shielded conduit into one of a first fluid stream and a second fluid stream; and re-combining said first fluid stream and said second fluid stream at a point downstream of said shielded conduit with said exhaust gas.

20. The method of mixing exhaust gas with inlet air, as set forth in claim 19, wherein said intake air contacts a fluid diverting portion of said shielded conduit and said intake air branching into said first fluid stream and second fluid stream, said first fluid stream and said second fluid stream flowing about said shielded conduit, and said first fluid stream and said second fluid stream disengaging from a fluid passing portion of said shielded conduit.

* * * * *